US011273637B2

(12) United States Patent
Hirai et al.

(10) Patent No.: US 11,273,637 B2
(45) Date of Patent: Mar. 15, 2022

(54) LIQUID EJECTION HEAD

(71) Applicant: Brother Kogyo Kabushiki Kaisha, Nagoya (JP)

(72) Inventors: Keita Hirai, Nagoya (JP); Shohei Koide, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/893,774

(22) Filed: Jun. 5, 2020

(65) Prior Publication Data

US 2020/0384764 A1 Dec. 10, 2020

(30) Foreign Application Priority Data

Jun. 5, 2019 (JP) ..... JP2019-105454

(51) Int. Cl.
*B41J 2/14* (2006.01)

(52) U.S. Cl.
CPC ..... *B41J 2/14* (2013.01); *B41J 2002/14419* (2013.01)

(58) Field of Classification Search
CPC ..... B41J 2/14; B41J 2002/14419; B41J 2002/14306; B41J 2202/12; B41J 2/14233; B41J 2/055
See application file for complete search history.

(56) References Cited

U.S. PATENT DOCUMENTS 7,926,921 B2 * 4/2011 Morita ..... B41J 2/1632 347/71

FOREIGN PATENT DOCUMENTS

JP 2008-290292 A 12/2008

OTHER PUBLICATIONS

IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid ejection head includes a nozzle, a pressure chamber configured to receive a pressure to eject liquid from the nozzle, a descender, and a communication channel. The descender has a first end and a second end opposite to each other. The first end is connected to the pressure chamber. The communication channel is connected to the second end and extends from a connection with the second end in an X direction. A first direction in which the descender extends from the second end toward the first end is inclined toward the communication channel relative to a Y direction orthogonal to the X direction.

13 Claims, 6 Drawing Sheets

LIQUID EJECTION HEAD

CROSS-REFERENCE TO RELATED APPLICATION

This application claims priority from Japanese Patent Application No. 2019-105454 filed on Jun. 5, 2019, the content of which is incorporated herein by reference in its entirety.

TECHNICAL FIELD

Aspects of the disclosure relate to a liquid ejection head.

BACKGROUND

In a known liquid ejection head, ink is supplied from a tank to a common supply main channel and flows, through a common supply branch channel and a supply channel, to a pressure chamber. Ink flows from the pressure chamber to a channel Ink is partially ejected from a nozzle communicating with the channel in form of droplets. Remaining ink, not ejected from the nozzle, passes from the channel through a discharge channel and a common discharge branch channel and then returns to the tank. In this manner, ink not ejected from the nozzle circulates between the tank and the pressure chamber.

SUMMARY

In the above liquid ejection head, the channel extends in a direction orthogonal to the discharge channel Thus, while ink flows from the pressure chamber through the channel toward the discharge channel, a flow rate of ink flowing in a downstream portion of the channel becomes slower on a side farther from the discharge channel than on a side closer to the discharge channel Such an area with the slower flow rate (for example, a liquid stagnation) may be likely to allow air bubbles to collect thereon. Air bubbles may absorb pressure required to eject droplets of ink from the nozzle, resulting in an ink ejection failure.

Aspects of the disclosure provide a liquid ejection head improving the ability of discharging air bubbles.

According to one or more aspects of the disclosure, a liquid ejection head includes a nozzle, a pressure chamber configured to receive a pressure to eject liquid from the nozzle, a descender, and a communication channel. The descender has a first end and a second end opposite to each other. The first end is connected to the pressure chamber. The communication channel is connected to the second end and extends from a connection with the second end in an X direction. A first direction in which the descender extends from the second end toward the first end is inclined toward the communication channel relative to a Y direction orthogonal to the X direction.

DETAILED DESCRIPTION

An illustrative embodiment of the disclosure will be described with reference to the drawings.

A liquid ejection apparatus 10 is configured to eject liquid and includes a liquid ejection head (hereinafter referred to as a "head") 20 according to an illustrative embodiment. Hereinafter, the liquid ejection apparatus 10 will be described by way of example as applied to, but not limited to, an inkjet printer.

<Structure of Liquid Ejection Apparatus>

Figure 1:
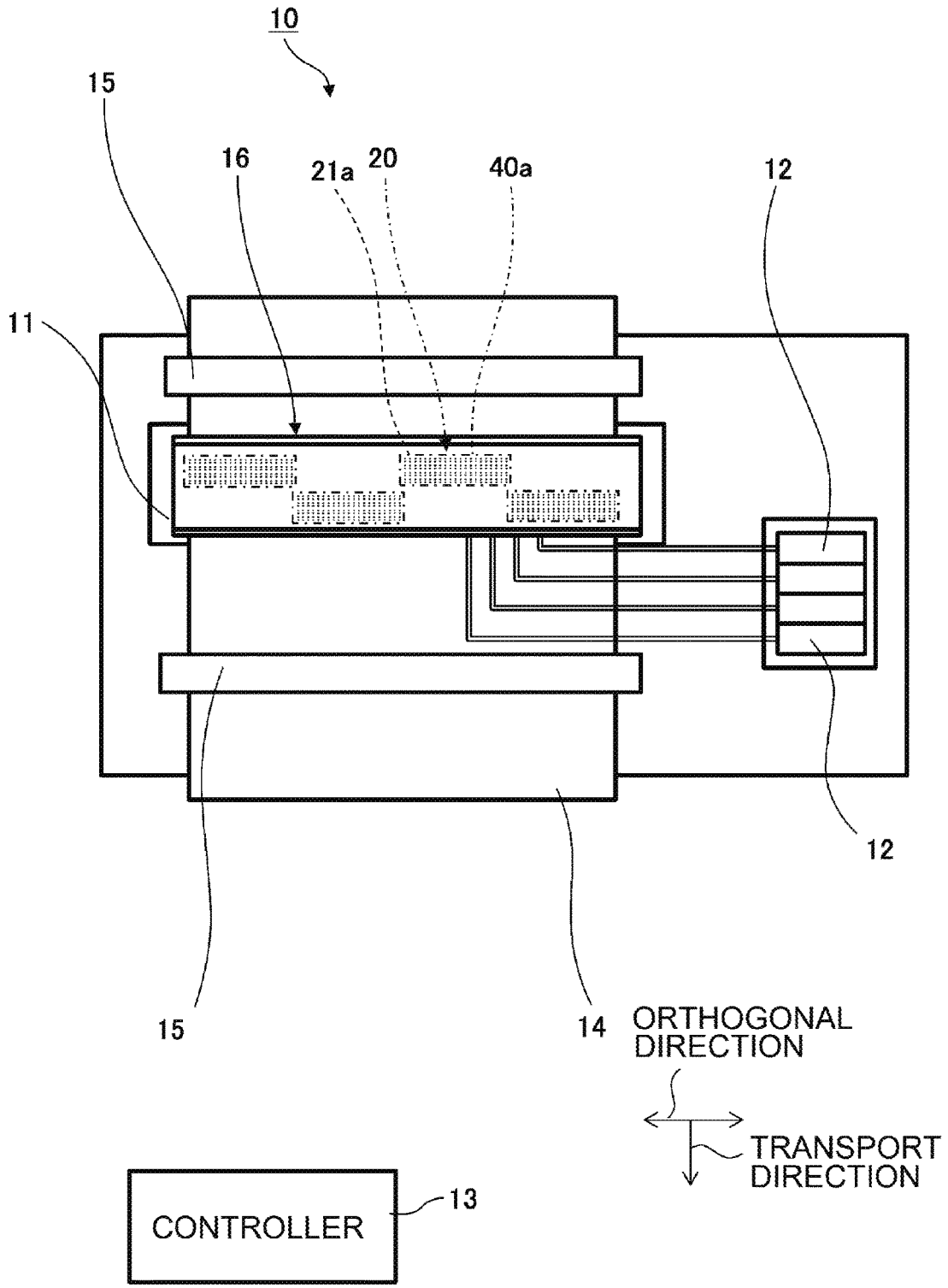
FIG. 1 is a schematic diagram of a liquid ejection apparatus including a liquid ejection head according to an illustrative embodiment.

As shown in FIG. 1, the liquid ejection apparatus 10 employs a line head type and includes a platen 11, a transport unit, a head unit 16, tanks 12, and a controller 13. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are disposed parallel to each other while interposing the platen 11 therebetween in a transport direction, and are connected to the transport motor. When the transport motor is driven, the transport rollers 15 rotate to transport the sheet 14 on the platen 11 in the transport direction.

The head unit 16 has a length greater than or equal to the length of the sheet 14 in a direction (an orthogonal direction) orthogonal to the transport direction of the sheet 14. The head unit 16 includes a plurality of heads 20.

Each head 20 includes a channel unit and a volume changer. The channel unit includes liquid channels formed therein and a plurality of nozzle holes 21*a* open on a lower surface (an ejection surface 40*a*). The volume changer is driven to change the volume of a liquid channel. In this case, a meniscus in a nozzle hole 21*a* vibrates and liquid is ejected from the nozzle hole 21*a*. The head 20 will be described in detail later. Separate tanks 12 are provided for different kinds of inks. For example, each of four tanks 12 stores therein a corresponding one of black, yellow, cyan, and magenta inks. Inks of the tanks 12 are supplied to corresponding nozzle holes 21*a* through liquid channels.

The controller 13 includes a processor such as a central processing unit (CPU), memories such as a random access memory (RAM) and a read only memory (ROM), and driver integrated circuits (ICs) such as an application specific integrated circuit (ASIC). In the controller 13, upon receipt of various requests and detection signals from sensors, the CPU causes the RAM to store various data and outputs various execution commands to the ASIC based on programs stored in the ROM. The ASIC controls each driver IC based on the commands to execute required operation. The transport motor and the volume changer are thereby driven.

Specifically, the controller 13 executes ejection from the head unit 16, and transport of sheets 14. The head unit 16 is controlled to eject ink from the nozzle holes 21*a*. A sheet 14 is transported in the transport direction intermittently by a predetermined amount. Printing progresses with execution of ink ejection and sheet transport.

<Structure of Head>

Figure 2:
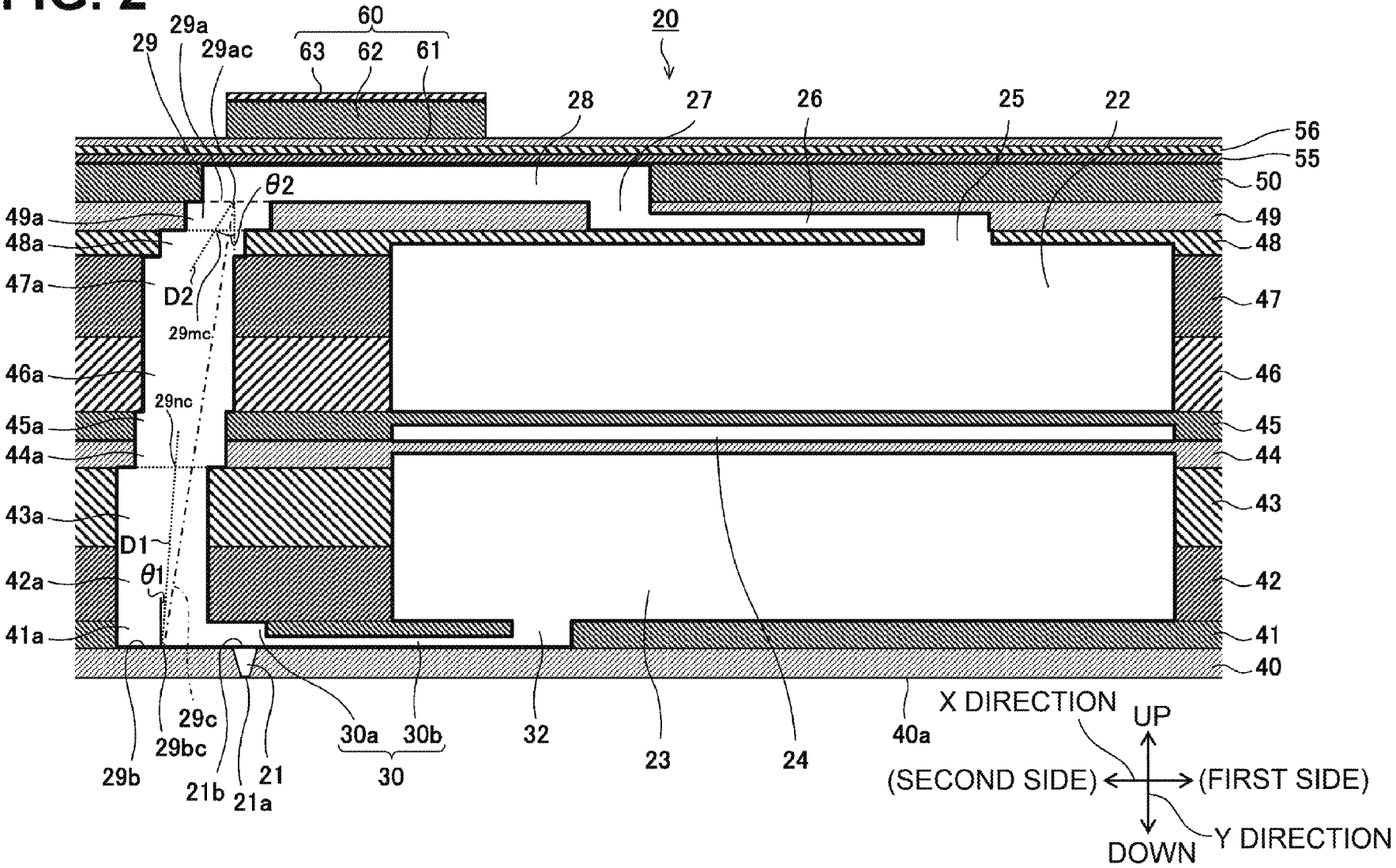
FIG. 2 is a cross-sectional view of the liquid ejection head of FIG. 1 taken along a line orthogonal to a Z direction.
Figure 3:
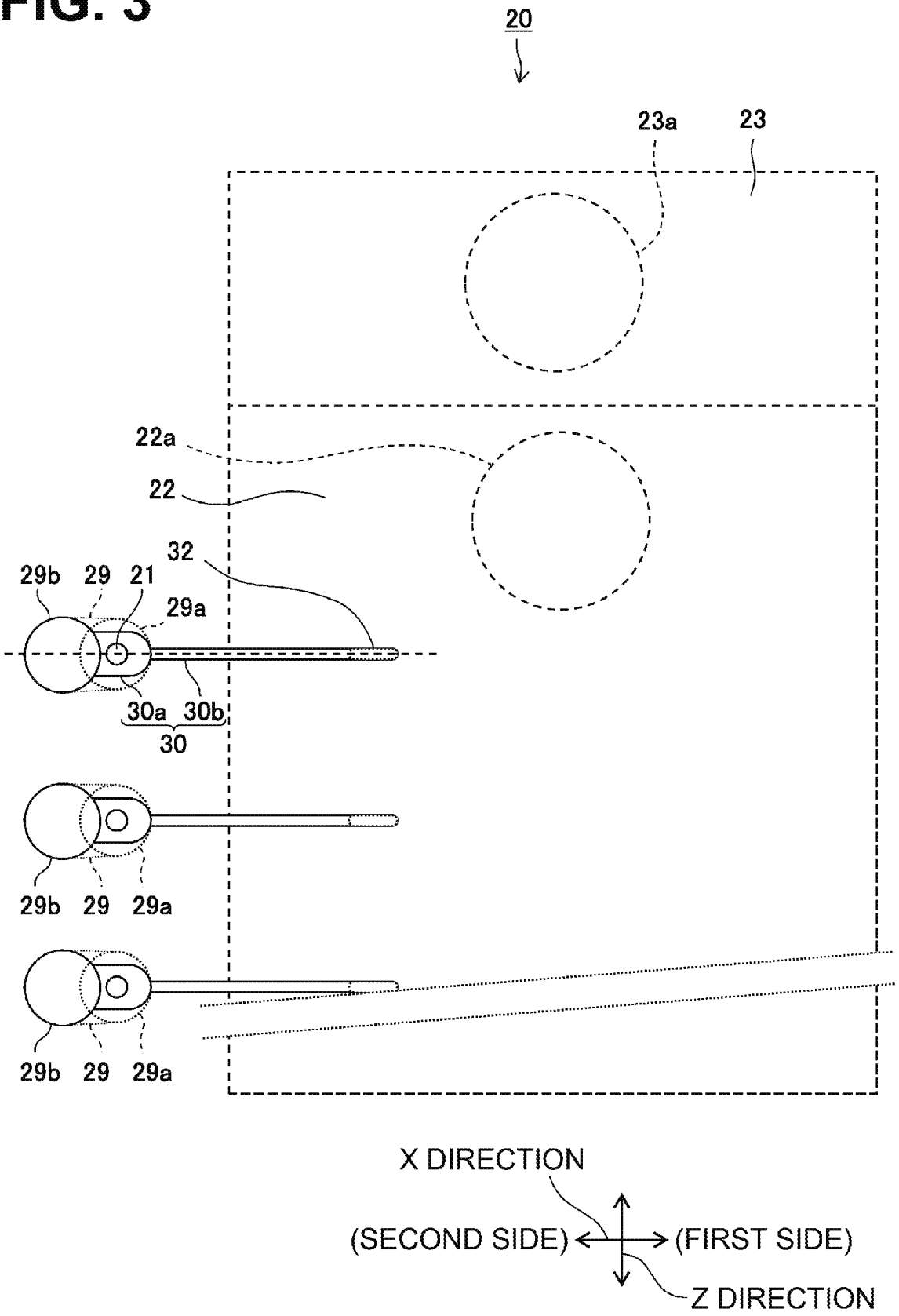
FIG. 3 is a top view of the liquid ejection head of FIG. 2 in a Y direction, showing a positional relation of constituent portions.

As described above, each head 20 includes the channel unit and the volume changer. As shown in FIGS. 2 and 3, the channel unit is formed by a stack of a plurality of plates, and the volume changer includes a vibration plate 55 and piezoelectric elements 60.

The plurality of plates include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, and a 10th channel plate 50. These plates are stacked in this order in a Y direction.

Each plate has holes and grooves of various sizes. A combination of holes and grooves in the stacked plates of the channel unit defines liquid channels such as a plurality of nozzles 21, a plurality of individual channels, a supply manifold 22, and a return manifold 23.

The nozzles 21 are formed to penetrate the nozzle plate 40 in the Y direction, and each have a tip opening (a nozzle hole 21*a*) and a base-end opening 21*b* opposite to the tip opening. For example, each nozzle 21 has a truncated cone shape, and the base-end opening 21*b* is greater in cross-sectional area than the nozzle hole 21*a*. The nozzle holes 21*a* of the nozzles 21 are arranged, as a nozzle array, in a Z direction on the ejection surface 40*a* of the nozzle plate 40.

The Z direction is orthogonal to the Y direction and may be parallel or inclined relative to the orthogonal direction shown in FIG. 1. The X direction is orthogonal to the Y direction and crosses the Z direction, and may be parallel or inclined relative to a scanning direction.

The supply manifold 22 and the return manifold 23 each extend long in the Z direction and are connected to the individual channels. The supply manifold 22 has, at its one end in its longitudinal direction, the supply opening 22*a*, and the return manifold 23 has, at its one end in its longitudinal direction, the return opening 23*a*. The supply manifold 22 is located above the return manifold 23, and overlaps the return manifold 23 in the Y direction.

The cross-sectional area (the Z cross-sectional area) of the supply manifold 22 orthogonal to the Z direction is equal to the cross-sectional area (the Z cross-sectional area) of the return manifold 23 orthogonal to the Z direction. For example, the supply manifold 22 and the return manifold 23 may be the same in size and shape in the X direction and the Y direction. The return manifold 23 may be longer in the Z direction than the supply manifold 22.

The supply manifold 22 is formed by through holes penetrating in the Y direction the sixth channel plate 46 and seventh channel plate 47, and a recess recessed from a lower surface of the eighth channel plate 48. The recess overlaps the through holes in the Y direction. A lower end of the supply manifold 22 is defined by the fifth channel plate 45, and an upper end of the supply manifold 22 is defined by an upper portion of the eighth channel plate 48.

The return manifold 23 is formed by through holes penetrating in the Y direction the second channel plate 42 and third channel plate 43, and a recess recessed from a lower surface of the fourth channel plate 44. The recess overlaps the through holes in the Y direction. A lower end of the return manifold 23 is defined by the first channel plate 41, and an upper end of the return manifold 23 is defined by an upper portion of the fourth channel plate 44.

A buffer space 24 is located between the supply manifold 22 and the return manifold 23. The buffer space 24 is formed by a recess recessed from a lower surface of the fifth channel plate 45. In the Y direction, the supply manifold 22 and the buffer space 24 are adjacent to each other via an upper portion of the fifth channel plate 45, and the return manifold 23 and the buffer space 24 are adjacent to each other via the upper portion of the fourth channel plate 44. The buffer space 24 located between the supply manifold 22 and the return manifold 23 may reduce interaction between the liquid pressure in the supply manifold 22 and the liquid pressure in the return manifold 23.

The plurality of individual channels are branched from the supply manifold 22 and merged into the return manifold 23. Each individual channel is connected, at its upstream end, to the supply manifold 22, connected, at its downstream end, to the return manifold 23, and connected, at its midstream, to a base-end opening 21*b* of a corresponding nozzle 21. Each individual channel includes a first communication hole 25, a throttle channel 26, a second communication hole 27, a pressure chamber 28, a descender 29, a communication channel 30, and a third communication hole 32, which are arranged in this order.

The first communication hole 25 is connected, at its lower end, to an upper end of the supply manifold 22, and extends upward from the supply manifold 22 in the Y direction, penetrating the upper portion of the eighth channel plate 48 in the Y direction. The first communication hole 25 is offset to one side (a first side) from a center of the supply manifold 22 in the X direction. The cross-sectional area (the Y cross-sectional area) of the first communication hole 25 orthogonal to the Y direction is less than the Z cross-sectional area of the supply manifold 22.

The throttle channel 26 is connected, at its first-side end, to an upper end of the first communication hole 25, and extends therefrom toward a second side in the X direction. The throttle channel 26 is formed by a groove recessed from a lower surface of the ninth channel plate 49. The cross-sectional area (the X cross-sectional area) of the throttle channel 26 orthogonal to the X direction is less than the Y cross-sectional area of the first communication hole 25.

The second communication hole 27 is connected, at its lower end, to a second-side end of the throttle channel 26, and extends from the throttle channel 26 upward in the Y direction, penetrating an upper portion of the ninth channel plate 49 in the Y direction. The second communication hole 27 is offset to the other side (a second side) from the center of the supply manifold 22 in the X direction. The cross-sectional area (the Y cross-sectional area) of the second communication hole 27 orthogonal to the Y direction is greater than the X cross-sectional area of the throttle channel 26.

The pressure chamber 28 is connected, at its first-side end, to an upper end of the second communication hole 27, and extends therefrom toward a second side in the X direction. The pressure chamber 28 penetrates the 10th channel plate 50 in the Y direction. The cross-sectional area (the X cross-sectional area) of the pressure chamber 28 orthogonal to the X direction is greater than or equal to the Y cross-sectional area of the second communication hole 27.

The descender 29 has a columnar shape, for example, a cylindrical column shape, and is located closer to the second side in the X direction than the supply manifold 22 and the return manifold 23. The descender 29 is formed by through holes in the first channel plate 41 through the ninth plate 49 and inclined relative to the Y direction.

The descender 29 has a first end 29*a* (e.g., its upper end), and a second end 29*b* (e.g., its lower end) opposite to the first end 29*a* in the Y direction. The first end 29*a* is connected to a second-side end of the pressure chamber 28. The descender 29 will be described in detail later.

The communication channel 30 is connected to the second end 29*b* of the descender 29, and extends from a connection with the second end 29*b* in the X direction to the return manifold 23. The communication channel 30 has a first portion 30*a* and a second portion 30*b*.

The first portion 30*a* is connected, at its second-side end, to the second end 29*b* of the descender 29 and extends from the descender 29 toward the first side in the X direction. The first portion 30*a* penetrates the first channel plate 41 in the Y direction. The cross-sectional area (the X cross-sectional area) of the first portion 30*a* orthogonal to the X direction is less than the cross-sectional area (Y cross-sectional area of the descender 29 orthogonal to the Y direction.

The base-end opening 21*b* of the nozzle 21 and the second end 29*b* of the descender 29 are connected to a lower end of the first portion 30*a*. Thus, the second end 29*b* of the descender 29 and the base-end opening 21*b* of the nozzle 21 do not overlap each other in the Y direction. The base-end opening 21*b* is located in the first portion 30*a*, which is located closer to the first side in the X direction than the second end 29*b*.

The second portion 30*b* is connected, at its second-side end, to the first-side end of the first portion 30*a* and extends from the first portion 30*a* toward the first side in the X direction. The second portion 30*b* is formed by a groove recessed from a lower surface of the first channel plate 41. The cross-sectional area (the X cross-sectional area) of the second portion 30*b* orthogonal to the X direction is less than the X cross-sectional area of the first portion 30*a*.

The third communication hole 32 is connected, at its lower end, to a first-side end of the second portion 30*b*, and extends from the second portion 30*b* upward in the Y direction, penetrating an upper portion of the first channel plate 41 in the Y direction. The third communication hole 32 is connected to a lower end of the return manifold 23. The third communication hole 32 is offset to the second side from the center of the return manifold 23 in the X direction. The cross-sectional area (the Y cross-sectional area) of the third communication hole 32 orthogonal to the Y direction is greater than the X cross-sectional area of the second portion 30*b*.

The vibration plate 55 is stacked on and above the 10th channel plate 50 to cover upper ends of openings of the pressure chambers 28. The vibration plate 55 may be integral with the 10th channel plate 50. In this case, each pressure chamber 28 may be recessed from a lower surface of the 10th channel plate 50 in the Y direction. An upper portion of the 10th channel plate 50, which is above each pressure chamber 28, may function as the vibration plate 55.

The piezoelectric elements 60 each include a common electrode 61, a piezoelectric layer 62, and an individual electrode 63 which are arranged in this order. The common electrode 61 entirely covers the vibration plate 55 via the insulating film 56. Each piezoelectric layer 62 is located on the common electrode 61 to overlap a corresponding pressure chamber 28. Each individual electrode 63 is located on a corresponding piezoelectric layer 62 to overlap a corresponding pressure chamber 28. In this case, a piezoelectric element 60 is formed by an individual electrode 63, a portion of the common electrode 61 overlapping the individual electrode 63, and a piezoelectric layer 62 (an active portion), which is sandwiched therebetween.

Each individual electrode 63 is electrically connected to a driver IC. The driver IC receives control signals from the controller 13 (FIG. 1) and generates and applies drive signals (voltage signals) selectively to each individual electrode 63. In contrast, the common electrode 61 is constantly maintained at a ground potential.

In response to a drive signal, an active portion of each selected piezoelectric layer 62 expands and contracts in a surface direction, together with the two electrodes 61 and 63. Accordingly, the vibration plate 55 corporates to deform to increase and decrease the volume of a corresponding pressure chamber 28. This applies a pressure to the corresponding pressure chamber 28 which in turn ejects liquid from a nozzle 21.

<Liquid Flow>

By way of example, the supply opening 22*a* of the supply manifold 22 is connected via a supply conduit to a subtank, and the return opening 23*a* of the return manifold 23 is connected via a return conduit to the subtank. When a pressure pump for the supply conduit and a negative-pressure pump for the return conduit are driven, liquid from the subtank passes through the supply conduit to flow into the supply manifold 22 where liquid flows in the Z direction.

Meanwhile, liquid partially flows into the individual channels. In each individual channel, liquid flows from the supply manifold 22, via the first communication hole 25, into the throttle channel 26 where liquid flows in the X direction. Liquid further flows from the throttle channel 26, via the second communication hole 27, into the pressure chamber 28 where liquid flows in the X direction. Then, liquid flows through the descender 29 from the first end 29*a* to the second end 29*b* in the Y direction and then through the first portion 30*a* of the communication channel 30 in the X direction, and enters the nozzle 21. When the piezoelectric element 60 applies a pressure to the pressure chamber 28, liquid is ejected from a nozzle hole 21*a* in form of droplets.

Remaining liquid flows from the descender 29 to the first portion 30*a* of the communication channel 30 in the X direction, passes through the second portion 30*b*, and enters the return manifold 23 via the third communication hole 32. Then, liquid flows in the return manifold 23 in the Z direction, and returns through the return conduit to the subtank. Thus, liquid not entering the individual channels circulates between the subtank and the individual channels.

<Descender Shape>

The descender 29 is formed by a first through hole 41*a* through a ninth through hole 49*a* formed in the first channel plate 41 through the ninth channel plate 49 respectively. The first through hole 41*a* through the ninth through hole 49*a* are arranged in this order in the Y direction, each having a columnar shape, for example, a cylindrical column shape.

For example, the first through hole 41*a* through third through hole 43*a* are identical in size and shape, and are located such that centers of their cross sections, each orthogonal to the Y direction, are aligned in the Y direction. The first through hole 41*a* through third through hole 43*a* thus form an integral column.

The fourth and fifth through holes 44*a*, 45*a* are identical in size and shape, and are located such that centers of their cross sections, each orthogonal to the Y direction, are aligned in the Y direction. The fourth and fifth through holes 44*a*, 45*a* thus form an integral column. The fourth through hole 44*a* and the fifth through hole 45*a* are identical in size and shape to the first through hole 41*a* through third through hole 43*a*, and are located closer to the first side in the X direction than the first through hole 41*a* through third through hole 43*a*.

The sixth and seventh through holes 46*a*, 47*a* are identical in size and shape, and are located such that centers of their cross sections, each orthogonal to the Y direction, are aligned in the Y direction. The sixth and seventh through holes 46*a*, 47*a* thus form an integral column. The sixth through hole 46*a* and the seventh through hole 47*a* are identical in size and shape to the fourth through hole 44*a* through fifth through hole 45*a*, and are located closer to the first side in the X direction than the fourth through hole 44*a* and the fifth through hole 45*a*.

The eighth through hole 48*a* is smaller in size than the seventh through hole 47*a* and is identical in shape with the seventh through hole 47*a*. The eighth through hole 48*a* is located closer to the first side in the X direction than the seventh through hole 47*a*.

The ninth through hole 49*a* is smaller in size than the eighth through hole 48*a* and is identical in shape with the eighth through hole 48*a*. The ninth through hole 49*a* is located closer to the first side in the X direction than the eighth through hole 48*a*.

Thus, the first through hole 41*a* through the ninth through hole 49*a* arranged from the second end 29*b* to the first end 29*a* are progressively inclined toward the first side in the X direction. The first through hole 41*a* through the ninth through hole 49*a* are located such that an imaginary line 29*c* that connects a center 29*ac* of the first end 29*a* and a center 29*bc* of the second end 29*b* passes therethrough. The descender 29 is thus formed such that each portion (the first through hole 41*a* through the ninth through holes 49*a*) of the descender 29 in its longitudinal direction includes the imaginary line 29*c*.

The descender 29 extends in a first direction D1 from the second end 29*b* toward the first end 29*a*. The first direction D1 is inclined from the second end 29*b* toward the communication channel 30 relative to the Y direction. An angle θ1 of inclination of the first direction D1 relative to the Y direction is, for example, greater than or equal to 5 degrees and less than or equal to 10 degrees.

For example, the first direction D1 is a direction in which a portion (or a lower portion) of the descender 29 including the second end 29*b* but not including the first end 29*a* extends. The lower portion refers to a portion having a specified length in a range from the second end 29*b* toward the first end 29*a*, for example, a portion closer to the second end 29*b* than a central portion of the descender 29 in the Y direction.

The first direction D1 may change, in a portion of the descender 29 closer to the first end 29*a* than to the second end 29*b*, to a direction in which a center of a cross-sectional area of the portion orthogonal to the Y direction changes from the center 29*bc* of the second end 29*b* in the X direction.

For example, the first direction D1 may be a direction extending from the center 29*bc* of the second end 29*b* to a center 29*nc* of a cross-sectional area of a lower surface of the fourth through hole 44*a*. Alternatively, the first direction D1 may be a direction extending from the center 29*bc* to a center of a cross-sectional area, orthogonal to the Y direction, of a central portion of the descender 29 in the Y direction.

The centers of the above cross-sectional areas are located closer to the first side in the X direction than the center 29*bc*. Thus, the lower portion of the descender 29 is inclined progressively further toward the first side in the X direction the farther it is from the second end 29*b* toward the first end 29*a*.

The first direction D1 may be a direction analogous to a line extending near the center 29*bc* and a center of one or more cross-sectional areas of the descender 20 closer to the first end 29*a* than to the second end 29*b*. In this case, the first direction D1 may not pass through the center 29*bc*.

The descender 29 also extends in a second direction D2 from the first end 29*a* toward the second end 29*b*. The second direction D2 is inclined from the first end 29*a* toward a side opposite to the communication channel 30 relative to the Y direction. For example, an angle θ2 of inclination of the second direction D2 relative to the Y direction is greater than the angle θ1 of inclination of the first direction D1 relative to the Y direction.

For example, the second direction D2 is a direction in which a portion (or an upper portion) of the descender 29 including the first end 29*a* but not including the second end 29*b* extends. The upper portion refers to a portion having a specified length in a range from the first end 29*a* toward the second end 29*b*, for example, a portion closer to the first end 29*a* than a central portion of the descender 29 in the Y direction.

The second direction D2 may change, in a portion of the descender 29 closer to the second end 29*b* than to the first end 29*a*, to a direction in which a center of a cross-sectional area of the portion orthogonal to the Y direction changes from the center 29*ac* of the second end 29*b* in the X direction.

For example, the second direction D2 may be a direction extending from the center 29*ac* of the first end 29*a* to a center 29*mc* of a cross-sectional area of an upper surface of the eighth through hole 48*a*. Alternatively, the first direction D1 may be a direction extending from the center 29*ac* to a center of a cross-sectional area, orthogonal to the Y direction, of a central portion of the descender 29 in the Y direction.

The centers of the above cross-sectional areas are located closer to the second side in the X direction than the center 29*ac*. Thus, the upper portion of the descender 29 is inclined progressively further toward the second side in the Y direction the farther it is away from the first end 29*a* toward the second end 29*b*.

The second direction D2 may be a direction analogous to a line connecting the center 29*ac* and a center of one or more cross-sectional areas of the descender 20 closer to the second end 29*b* than to the first end 29*a*. In this case, the second direction D2 may not pass through the center 29*ac*.

The descender 29 is thus inclined such that the second end 29*b* is located closer to the second side in the X direction (a side opposite to the communication channel 30) than the first end 29*a*. The imaginary line 29*c* of the descender 29 extending from the second end 29*b* toward the first end 29*a* is inclined toward the first side in the X direction.

As shown in FIG. 3, a head 20 has a plurality of descenders 29. A first-side end of a first end 29*a* of each descender 29 is located on a first-side end of a first portion 30*a* of a corresponding communication channel 30. The centers 29*ac*, 29*bc* of the descender 29 are located on central axes of the first portion 30*a* and a second portion 30*b* of the communication channel 30. A dimension in the Z direction reduces in order of the descender 29, the first portion 30*a*, and the second portion 30*b*.

<Operation and Effects>

In the head 20, the first direction D1 in which the descender 29 extends from the second end 29*b* toward the first end 29*a* is inclined toward the communication channel 30 relative to the Y direction orthogonal to the X direction.

For example, if the descender 29 extends straightly in the Y direction, liquid may flow through the descender 29 from the first end 29*a* to the second end 29*b* and then enter the communication channel 30 from the second end 29*b*. Thus, in the descender 29, liquid flowing toward the second end 29*b* may be drawn toward the communication channel 30. This may stagnate the flow of liquid on a side opposite to the communication channel 30 and cause air bubbles to collect thereon.

In contrast, the descender 29 extending from the first end 29*a* toward the second end 29*b* is inclined toward a side opposite to the communication channel 30 in the X direction (toward the second side in the X direction). Thus, liquid flowing in the descender 29 from the first end 29*a* toward the second end 29*b* is led to the second side. This flow allows discharge of air bubbles from the second side where the flow of liquid is likely to slow down.

In the head 20, the angle θ1 of inclination of the first direction D1 relative to the Y direction is greater than or equal to 5 degrees and less than or equal to 10 degrees. The angle θ1 of inclination having 5 degrees or more allows liquid to smoothly flow in a portion of the descender 29 opposite to the communication channel 30. This flow enables adequate discharge of air bubbles. The angle θ1 of inclination having 10 degrees or less may reduce the descender 29 inclined in the X direction from upsizing, thus obviating the necessity to upsize the head 20.

In the head 20, the second direction D2 in which the descender 29 extends from the first end 29*a* toward the second end 29*b* is inclined toward a side opposite to the communication channel 30 relative to the Y direction. Thus, liquid flowing in the descender 29 from the first end 29*a* toward the second end 29*b* is led to the side opposite to the communication channel 30 (the second side) in the X direction. This flow allows discharge of air bubbles on the second side in a portion of the descender 29 closer to the first end 29*a* (or an upper portion thereof).

In the head 20, the angle θ1 of inclination of the first direction D1 relative to the Y direction is smaller than the angle θ2 of inclination of the second direction D2 relative to the Y direction. The greater the angle θ2 of inclination of the second direction D2 is, the greater the flow rate of liquid flowing, at the start of the descender 29, toward the side opposite to the communication channel 30 becomes. This enables more liquid to flow to the side opposite to the communication channel 30 throughout the descender 29. This flow allows discharge of air bubbles from the side opposite to the communication channel 30.

In the head 20, the descender 29 is formed such that each portion of the descender 29 in its longitudinal direction includes the imaginary line 29*c* connecting the center 29*ac* of the first end 29*a* and the center 29*bc* of the second end 29*b*.

Limiting the inclination of the descender 29 to the extent described above may reduce pressure loss in the liquid flow in the descender 29. This enables liquid to smoothly flow in the descender 29 and thus discharge air bubbles.

In the head 20, the communication channel 30 has the first portion 30*a* and the second portion 30*b*. The first portion 30*a* is connected to the descender 29 and is located between the descender 29 and the second portion 30*b* in the X direction. The second portion 30*b* is smaller in cross-sectional area than the first portion 30*a*.

This enables liquid to flow in the descender 29, the first portion 30*a*, and the second portion 30*b* in this order with a reduced pressure loss and an enhanced ability to discharge air bubbles from the descender 29 and the communication channel 30.

In the head 20, in the Z direction orthogonal to the X direction and the Y direction, a dimension of the first portion 30*a* is smaller than a dimension of the descender 29 and greater than a dimension of the second portion 30*b*.

Accordingly, the dimension in the Z direction reduces in order of the descender 29, the first portion 30*a*, and the second portion 30*b*. This enables liquid to flow in the descender 29, the first portion 30*a*, and the second portion 30*b* in this order, with a reduced liquid stagnation and an enhanced ability to discharge air bubbles from the descender 29 and the communication channel 30.

The head 20 has a stack structure having stacked plates (channel plates 41-49) having through holes 41*a*-49*a* formed therein. The descender 29 is formed by the through holes 41*a*-49*a* formed in the stack structure.

Thus, the descender 29 can be easily formed by only stacking the channel plates 41-49 each formed with a corresponding one of the through holes 41*a*-49*a*.

The head 20 includes the return manifold 23 connected to the communication channel 30, the supply manifold 22 located above the return manifold 23, and the throttle channel 26 connected to the pressure chamber 28 and the supply manifold 22 and having a smaller cross-sectional area than the pressure chamber 28.

The supply manifold 22 and the return manifold 23 overlapping each other in the Y direction are located closer to the one side (for example, the first side) in the X direction than the descender 29. This may obviate the need to upsize the head 20 in the X direction.

First Modification

In a head 20 according to a first modification, a descender 29 may have a cross-sectional area reducing in a direction from a first end 29*a* toward a second end 29*b*.

Specifically, the descender 29 is formed by a first through hole 41*a* through ninth through hole 49*a*. A cross-sectional area orthogonal to the Y direction reduces in order of the ninth through hole 49*a* to the first through hole 41*a*. Thus, the cross-sectional area of the first through hole 41*a* is smaller than that of the ninth through hole 49*a*.

In the ninth through hole 49*a* through the first through hole 41*a*, a cross-sectional area of a through hole is smaller than that of its adjacent through hole located closer to the first end 29*a*. In this case, a cross-sectional area of each through hole may be smaller than that of its corresponding adjacent through hole closer to the first end 29*a*. Alternatively, among the ninth through hole 49*a* through the first through hole 41*a*, some adjacent through holes may have the same cross-sectional area smaller than a cross-sectional area of an adjacent through hole located closer to the first end 29*a*.

Thus, when liquid flows in the descender 29 from the first end 29*a* toward the second end 29*b*, its flow rate may increase according to the descender 29 tapering in a direction from the first end 29*a* toward the second end 29*b*. This provides an enhanced ability to discharge air bubbles near the second end 29*b* of the descender 29.

Second Modification

Figure 4:
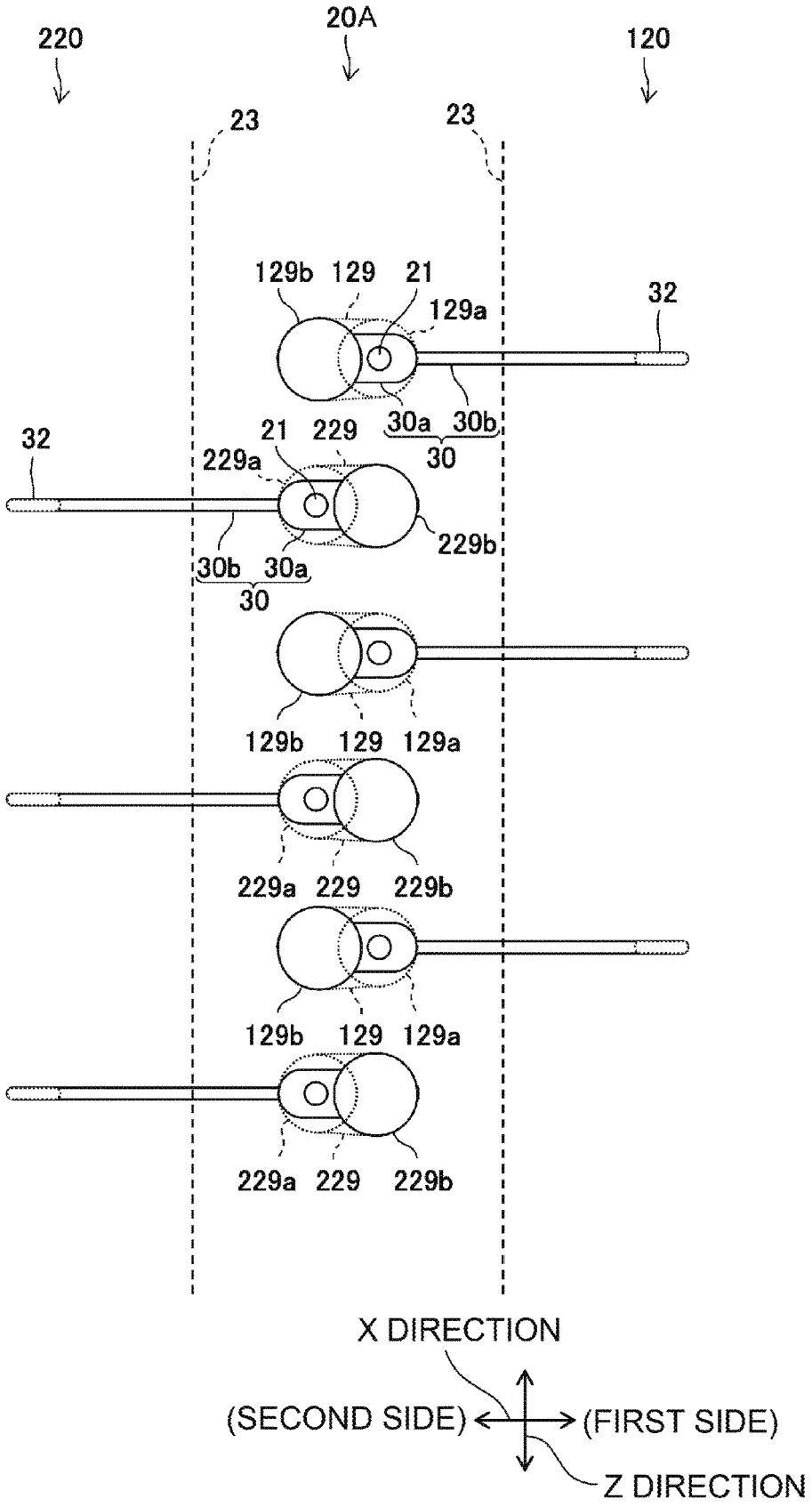
FIG. 4 is a top view of a liquid ejection head in a Y direction, according to a second modification of the illustrative embodiment, showing a positional relation of constituent portions.

As shown in FIG. 4, a head 20A according to a second modification includes first descenders 129 and second descenders 229. Second ends 129*b* of the first descenders 129 and second ends 229*b* of the second descenders 229 are alternately arranged.

Specifically, the head 20A includes a plurality of return manifolds arranged in the X direction. The return manifolds include a first return manifold 120 and a second return manifold 220 arranged adjacent to each other in the X direction. The first return manifold 120 is connected to a plurality of first descenders 129 and the second return manifold 220 is connected to a plurality of second descenders 229.

The first return manifold 120 is connected to the first descenders 129 via communication channels 30 each extending from a corresponding one of the descenders 129 toward one side (the first side) in the X direction. The second return manifold 220 is connected to the second descenders 229 via communication channels 30 each extending from a corresponding second descender 229 to the other side (the second side) in the X direction.

Thus, each first descender 129 extending from a first end 129*a* to a second end 129*b* is inclined to the second side in the X direction. Each second descender 229 extending from a first end 229*a* to a second end 229*b* is inclined to the first side in the X direction. The first end 129*a* is located closer to the first side in the X direction than the first end 229*a*, and the second end 229*b* is located closer to the second side in the X direction than the second end 229*b*.

The first descenders 129 are aligned in the Z direction and form a row, and the second descenders 229 are aligned in the Z direction and form a row. In the row of the first descenders 129, the first ends 129*a* of the first descenders 129 are aligned in the Z direction, and the second ends 129*b* are aligned in the Z direction. In the row of the second descenders 229, the first ends 229*a* of the second descenders 229 are aligned in the Z direction, and the second ends 229*b* are aligned in the Z direction.

In the X and Z directions, the first ends 129*a* and the first ends 229*a* are staggered and the second ends 129*b* and the second ends 229*b* are staggered. The row of the first ends 129*a* and the row of the second ends 229*b* may be on the same line or collinear and the row of the second ends 129*b* and the row of the first ends 229*a* may be collinear. In this case, the row of the first descenders 129 and the row of the second descenders 229 may be collinear and coincide with each other in the X direction when viewed in the Z direction.

The first descenders 129 and the second descenders 229 thus coincide with each other in the X direction although they are inclined in the X direction. This may obviate the need to upsize the head 20A in the X direction by using the positional coincidence in the X direction.

Additionally, the row of the first ends 229*a* and the row of the second ends 229*b* may be located between the row of the first ends 129*a* and the row of the second ends 129*b* in the X direction. In this case, when viewed in the Z direction, the row of the first descenders 129 overlaps the row of the second descenders 229 in the X direction. This may obviate the need to upsize the head 20A in the X direction.

Third Modification

Figure 5:
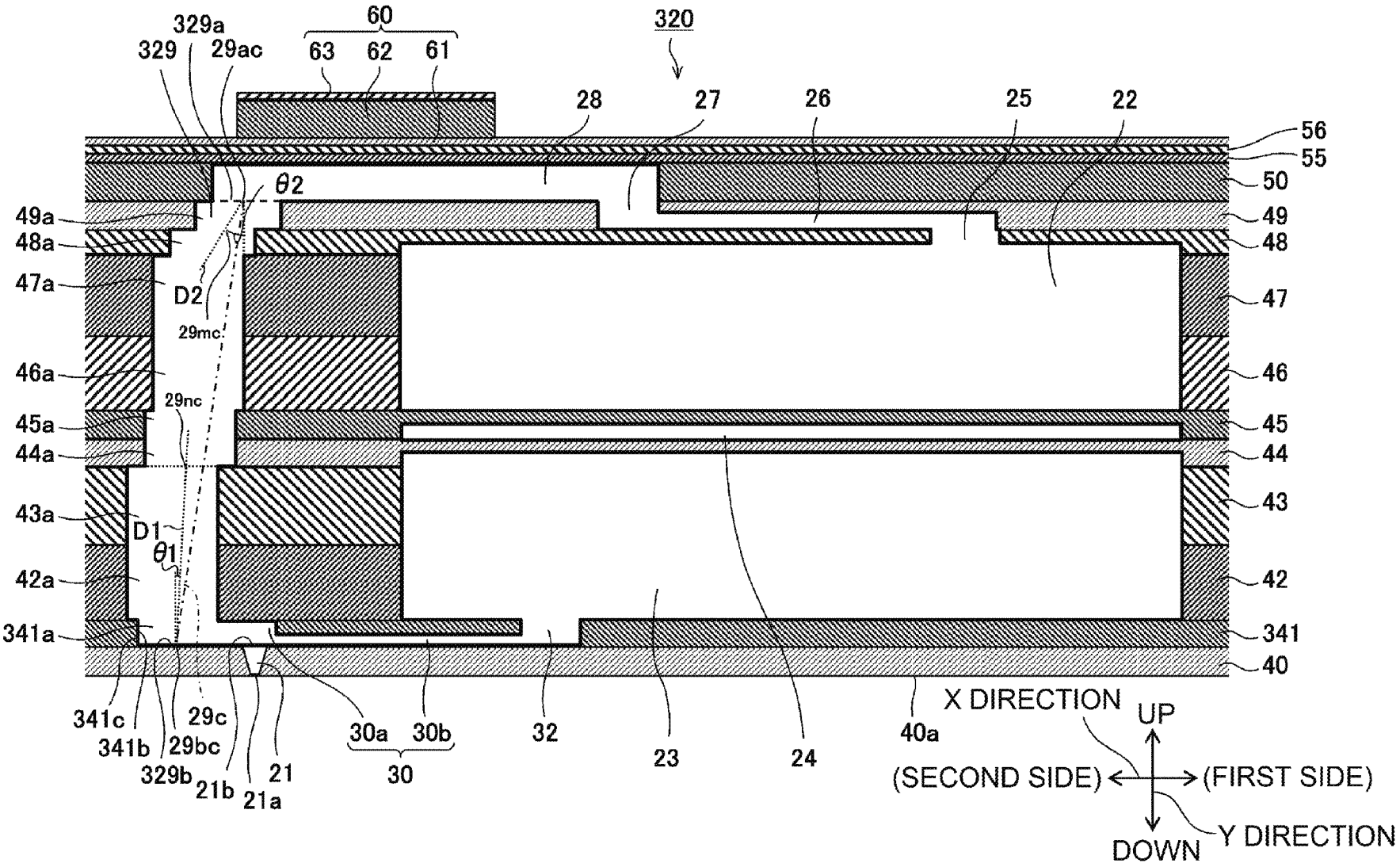
FIG. 5 is a cross-sectional view of a liquid ejection head according to a third modification of the illustrative embodiment, taken along a line orthogonal to a Z direction.

In a head 320 according to a third modification shown in FIG. 5, a descender 329 has a second end 329*b*. A surface near the second end 329*b* defining a portion of the descender 329 opposite to the communication channel 30 protrudes toward the communication channel 30.

Specifically, the descender 329 is formed by a first through hole 341*a* and a second through hole 42*a* through ninth through hole 49*a*. The first through hole 341*a* is formed in a first channel plate 341 and defines a portion of the descender 329 near the second end 329*b*. The first through hole 341*a* is defined by an inner peripheral surface 341*b* of the first channel plate 341 or the inner peripheral surface 341*b* surrounds the first through hole 341*a*.

A second side of the inner peripheral surface 341*b* protrudes toward a first side in the X direction. In other words, the second side of the inner peripheral surface 341*b* is defined by a protrusion 341*a* protruding toward the first side in the X direction. By the protrusion 341*a*, the first through hole 341*a* is narrower in the X direction than the second through hole 42*a*. Thus, a corner formed by the second end 329*b* of the descender 329 and the protrusion 341*c* is located further toward the first side in the X direction than a corner formed at the second through hole 42*a*. This provides an enhanced ability to discharge air bubbles near the second end 329*b* of the descender 329.

A first direction D1 extending from the second end 329*b* of the descender 329 may be set without consideration of the protrusion 341*c*.

Fourth Modification

Figure 6:
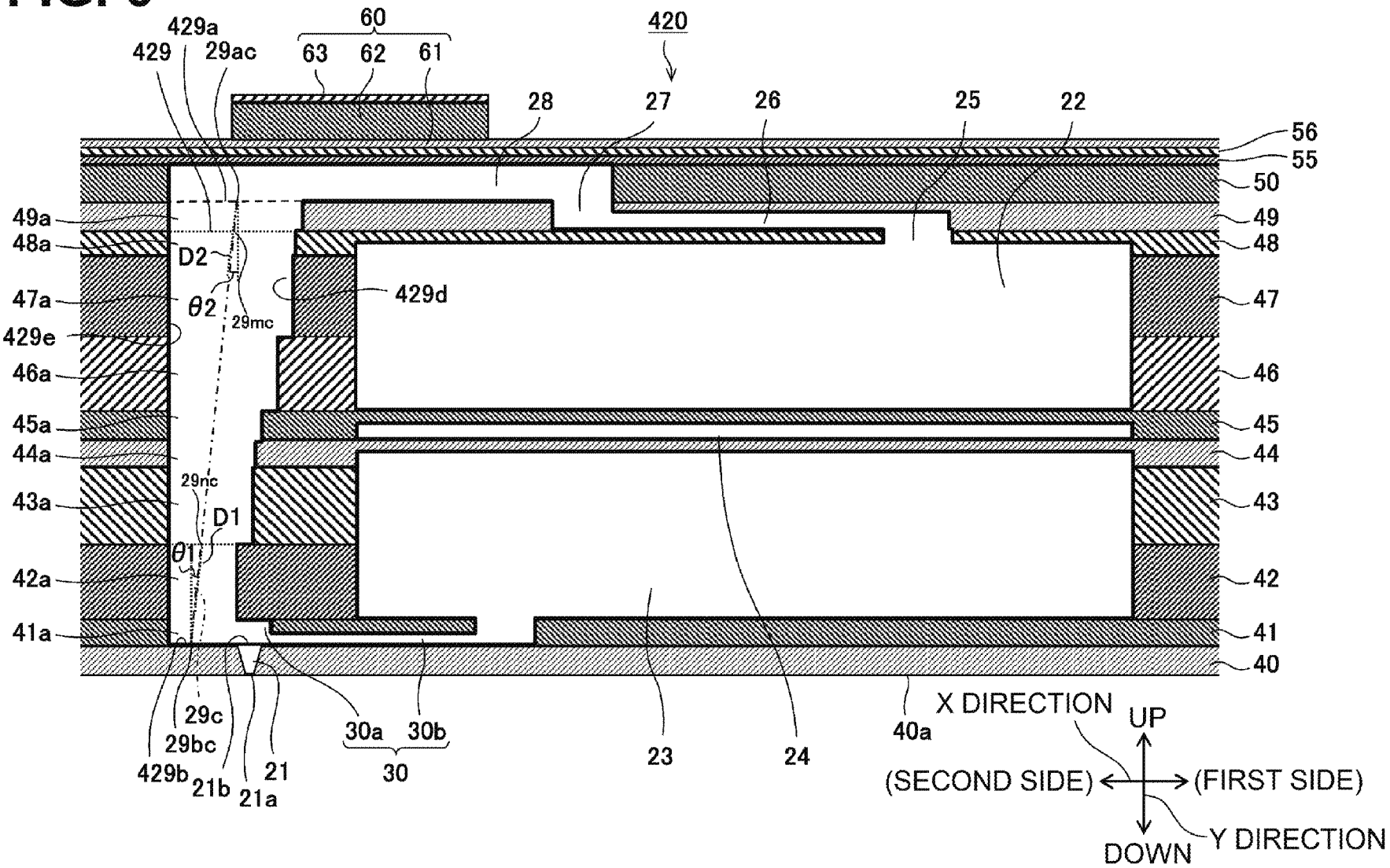
FIG. 6 is a cross-sectional view of a liquid ejection head according to a fourth modification of the illustrative embodiment, taken along a line orthogonal to a Z direction.

In a head 420 according to a fourth modification shown in FIG. 6, a descender 429 extending from a second end 429*b* to a first end 429*a* has a side toward a communication channel 30 in the X direction, or a first side of the descender 429, and the side is inclined toward the communication channel 30 relative to the Y direction.

For example, the descender 429 has a truncated cone shape in which the cross-sectional area of the second end 429*b* is smaller than that of the first end 429*a*. The cross-section of the descender 429 orthogonal to the Z direction may be shaped like a trapezoid such as a right trapezoid.

The cross-sectional area of the descender 429 orthogonal to the Z direction has a first edge 429*d* on its first side in the X direction and a second edge 429*e* on its second side in the X direction. An angle between the first end 429*a* and the first edge 429*d* is smaller than an angle between the first end 429*a* and the second edge 429*e*, and is, for example, an acute angle. The angle between the first end 429*a* and the second edge 429*e* may be a right angle.

The first edge 429*d* of the descender 429 extending from the first end 429*a* to the second end 429*b* is inclined to the second side in the X direction. This leads the flow of liquid near the second end 429*b* to the second side and provides an enhanced ability to discharge air bubbles near the second end 429*b*.

In the above example, the second edge 429*e* of the descender 429 extends in the Y direction. However, when the first direction D1 is inclined, relative to the Y direction, toward the communication channel 30, the second edge 429*e* may be inclined, relative to the Y direction, toward the communication channel 30 or its opposite side. In this case, for example, the first direction D1 may be a direction extending from the center 29*bc* of the second end 29*b* to a center 29*nc* of a cross-sectional area of a lower surface of the third through hole 43*a*.

ALTERNATIVE MODIFICATIONS

In the illustrative embodiment and its modifications, a communication channel 30 has a first portion 30*a* and a second portion 30*b*. However, the communication channel 30 may have a second portion 30*b* only. A first portion 30*a* may be omitted from the communication channel 30.

Even in this case, the second portion 30*b* may prevent a pressure applied to the pressure chamber 28 by the piezoelectric element 60 from escaping to the return manifold 23. Thus, the pressure applied by the piezoelectric element 60 propagates from the pressure chamber 28 through the descender 29, 129, 229, 329, 429 to the nozzle 21 and thus liquid is ejected from the nozzle hole 21*a*.

In the illustrative embodiment and its modifications, the descender 29 has the second direction D2 inclined to a side opposite to the communication channel 30 relative to the Y direction. The second direction D2, however, may extend in the Y direction.

The illustrative embodiment and its modifications may be utilized in combination unless mutually excluding. For example, in the second through fourth modifications and their combinations, the cross-sectional area of the descender may reduce in a direction from the first end toward the second end as with the first modification. In the first, third and fourth modifications and their combinations, as with the second modification, the second ends of the first descenders and the second ends of the second descenders may be alternately arranged. In the first, second and fourth modifications and their combinations, as with the third modification, a corner on a second side, in an X direction, of a first through hole defined by a second end of a descender may be located further toward a first side in the X direction than a corner on a second side of a second through hole in the X direction. In the first through third modifications and their combinations, as with the fourth modification, a descender extending from the second end toward the first end may be inclined toward a communication channel.

From the above description, other modifications and embodiments of the disclosure will be apparent to those skilled in the art. The above description should be thus interpreted as mere examples and is provided for the purpose of disclosing the best mode such that those skilled in the art could practice it. Various changes, arrangements and modifications may be applied therein without departing from the spirit and scope of the disclosure.

What is claimed is:

1. A liquid ejection head comprising:

a nozzle;

a pressure chamber configured to receive a pressure to eject liquid from the nozzle;

a descender having a first end and a second end opposite to each other, the first end being connected to the pressure chamber; and a communication channel connected to the second end and extending from a connection with the second end in an X direction, wherein a first direction in which the descender extends from the second end toward the first end is inclined toward the communication channel relative to a Y direction orthogonal to the X direction, and wherein the second end of the descender does not overlap the communication channel in the Y direction.

2. The liquid ejection head according to claim 1, wherein an angle of inclination of the first direction relative to the Y direction is greater than or equal to 5 degrees and less than or equal to 10 degrees.

3. The liquid ejection head according to claim 1, wherein a second direction in which the descender extends from the first end toward the second end is inclined toward a side opposite to the communication channel relative to the Y direction.

4. The liquid ejection head according to claim 3, wherein an angle of inclination of the first direction relative to the Y direction is smaller than an angle of inclination of the second direction relative to the Y direction.

5. The liquid ejection head according to claim 1, wherein the descender is formed such that each portion of the descender in a longitudinal direction thereof includes an imaginary line connecting a center of the first end and a center of the second end.

6. The liquid ejection head according to claim 1, wherein the descender has a cross-sectional area reducing in a direction from the first end toward the second end.

7. The liquid ejection head according to claim 1, wherein the descender extending from the second end to the first end has a side toward the communication channel in the X direction, the side being inclined toward the communication channel 30 relative to the Y direction.

8. The liquid ejection head according to claim 1, wherein a surface near the second end of the descender defining a portion of the descender opposite to the communication channel protrudes toward the communication channel.

9. The liquid ejection head according to claim 1, wherein the communication channel has a first portion and a second portion, the first portion being connected to the descender and located between the descender and the second portion in the X direction, the second portion being smaller in cross-sectional area than the first portion.

10. The liquid ejection head according to claim 9, wherein in a Z direction orthogonal to the X direction and the Y direction, a dimension of the first portion is smaller than a dimension of the descender and greater than a dimension of the second portion.

11. The liquid ejection head according to claim 1, wherein the descender includes a plurality of first descenders and a plurality of second descenders, and wherein the first descenders and the second descenders are alternately arranged in the X direction and a Z direction orthogonal to the X direction and the Y direction.

12. The liquid ejection head according to claim 1, further comprising a stack structure having a plurality of plates stacked one on another, the plates having through holes formed therein, wherein the descender is formed by the through holes formed in the stack structure.

13. The liquid ejection head according to claim 1, further comprising:

a return manifold connected to the communication channel;

a supply manifold located overlapping the return manifold; and a throttle channel connected to the pressure chamber and the supply manifold, the throttle channel having a cross-sectional area smaller than a cross-sectional area of the pressure chamber.

* * * * *